US006665414B1

(12) United States Patent
Murayama et al.

(10) Patent No.: US 6,665,414 B1
(45) Date of Patent: Dec. 16, 2003

(54) SPEAKER SYSTEM AND COOLING DEVICE THEREFOR

(75) Inventors: Fumio Murayama, Tendo (JP); Takashi Suzuki, Tendo (JP); Takeshi Tokusho, Tendo (JP)

(73) Assignees: Pioneer Corporation, Tokyo (JP); Tohoku Pioneer Corporation, Yamagata-Ken (JP)

( * ) Notice: Subject to any disclaimer, the term of this patent is extended or adjusted under 35 U.S.C. 154(b) by 161 days.

(21) Appl. No.: 09/670,569

(22) Filed: Sep. 27, 2000

(30) Foreign Application Priority Data

Sep. 27, 1999 (JP) ..... 11-312841

(51) Int. Cl.[7] ..... H04R 25/00
(52) U.S. Cl. ..... 381/397; 381/412; 310/16
(58) Field of Search ..... 381/396, 397, 381/407, 410, 412, 414, 419, 420; 310/16

(56) References Cited

U.S. PATENT DOCUMENTS 4,210,778 A * 7/1980 Sakurai et al. ..... 381/397
4,933,975 A * 6/1990 Button ..... 381/397
5,835,612 A * 11/1998 Fujihira et al. ..... 381/412
6,175,637 B1 * 1/2001 Fujihira et al. ..... 381/412

* cited by examiner

*Primary Examiner*—Curtis Kuntz
*Assistant Examiner*—Suhan Ni
(74) *Attorney, Agent, or Firm*—Sughrue Mion, PLLC

(57) ABSTRACT

A speaker system and a cooling device therefor is provided which is capable of effectively dissipating heat generated by a voice coil. The cooling device is formed as a unitary member having a first member having a hollow cylindrical shape which is integrally formed with a second member having a hollow cylindrical shape which is concentric thereto and has a larger diameter than the first member, and a plurality of third members each in the form of a plate and radially arranged between the first member and the second member for connecting the members. The first member is arranged adjacent to the voice coil and at the same time inside a magnetic flux loop generated by a magnetic circuit, and the second member is arranged outside the magnetic flux loop, so that heat generated by the voice coil can be efficiently dissipated from the second member.

25 Claims, 7 Drawing Sheets

SPEAKER SYSTEM AND COOLING DEVICE THEREFOR

BACKGROUND OF THE INVENTION

1. Field of the Invention

This invention relates to a speaker system and a cooling device therefor.

2. Description of the Related Art

Conventionally, a sound system for automobile use and the like has been actively high-powered, and accordingly, heat dissipation of the speaker system has been increasingly important. FIGS. 1A and 1B are diagrams each showing the construction of a conventional speaker. The construction of the speaker 10 will be briefly described with reference to these figures. FIG. 1A is a cross-sectional view showing essential parts of the speaker 10. FIG. 1B is a cross-sectional view showing essential parts of the speaker 10 to which a cooling device 11 is attached.

Speaker 10 has a magnetic circuit including a disk-shaped bottom yoke 1 formed of a magnetic metal member and having a hollow cylindrical pole portion la, an annular magnet 2 placed on the bottom yoke 1, and an annular top yoke 3 formed of a magnetic metal member and placed on the magnet 2. Further, a diaphragm 7 with a dust cap 7*a* arranged at a center thereof is suspended on a frame 4 via an edge 5 and a damper 6, and joined to a coil bobbin 9 having a voice coil 8 wound therearound. The coil bobbin 9 is arranged in a magnetic gap formed by the magnetic circuit.

The magnetic circuit has a magnetic path (indicated by arrows in the figures, for instance) formed by the bottom yoke 1, the top yoke 3, and the magnet 2. A gap between an end of the pole portion la and the top yoke 3 forms the magnetic gap for collecting the magnetic flux of the magnet 2 and thereby generates a high-density uniform magnetic field. When a drive current is supplied to the voice coil 8 through a power amplifier circuit, not shown, the coil bobbin 9 arranged in the magnetic gap with predetermined spaces from the pole portion la and the top yoke 3 is actuated to perform a reciprocating motion by an electromagnetic force generated in the magnetic gap. The reciprocating motion is transmitted to the diaphragm 7 whereby sounds are emitted. In short, an electrical signal is converted to acoustic vibrations. In the case of speaker 10, especially when a large drive current is continuously supplied, the voice coil 8 generates Joule heat to thereby increase the temperature of the whole magnetic circuit formed by the bottom yoke 1 and its associated components.

To eliminate the above inconvenience, it is possible to employ a method of fitting a cooling device 11, which is formed by a disk-shaped member highly efficient in thermal conductivity, with a concentric groove formed therein, in the pole portion la of the bottom yoke 1. That is, if the cooling device 11 formed with the groove in which the disk-shaped bottom yoke 1 can be fitted is used, heat from the magnetic circuit can be emitted simply by mounting the device 11 on the bottom yoke 1 of the speaker 10, as shown in FIG. 1B.

However, heat generated by the voice coil 8 is gradually transferred to the bottom yoke 1 and the top yoke 3. Therefore, it takes time before the heat generated by the voice coil 8 is accumulated in the bottom yoke 1 and the top yoke 3, which prevents effective transfer of heat from the voice coil 8 to the cooling device 11.

OBJECTS AND SUMMARY OF THE INVENTION

The invention has been made in view of the above problems, and it is an object of the invention to provide a speaker system and a cooling device therefor which are capable of effectively dissipating heat generated by a voice coil.

To attain the above object, according to a first aspect of the invention, there is provided a speaker system including a magnetic circuit having a magnetic gap, a voice coil arranged in the magnetic gap, and a diaphragm attached to the voice coil, the voice coil and diaphragm being driven by supplying a drive current to the voice coil, comprising a first member arranged adjacent to the voice coil and inside a magnetic flux loop generated by the magnetic circuit, a second member arranged outside the magnetic flux loop generated by the magnetic circuit, and a third member connecting the first member and the second member to each other, wherein the first to third members are formed of a material excellent in thermal conductivity.

Preferably, the magnetic circuit is of an outer magnet type.

Preferably, the magnetic circuit is of an inner magnet type.

To attain the above object, according to a second aspect of the invention, there is provided a cooling device for a speaker system, comprising a first member arranged adjacent to a voice coil and inside a magnetic flux loop generated by a magnetic circuit, a second member arranged outside the magnetic flux loop generated by the magnetic circuit; and a third member connecting the first member and the second member to each other, wherein the first to third members are formed of a material excellent in thermal conductivity.

Preferably, heat generated in the voice coil is transferred to the second member via the first member and the third member to thereby allow the heat to be dissipated from the second member.

Preferably, the first to third members are integrally formed as a unitary member.

According to the speaker system and the cooling device therefor, the first member is arranged adjacent to the voice coil and at the same time inside the magnetic flux loop generated by the magnetic circuit, and the second member is arranged outside the magnetic flux loop, with the third member connecting the first member and the second member. Further, the first to third members are formed of a material excellent in thermal conductivity. Therefore, heat generated by the voice coil is transferred in the order of the first member, the third member, and the second member, thereby being dissipated from the second member.

DETAILED DESCRIPTION OF THE PREFERRED EMBODIMENT

Figure 1A:
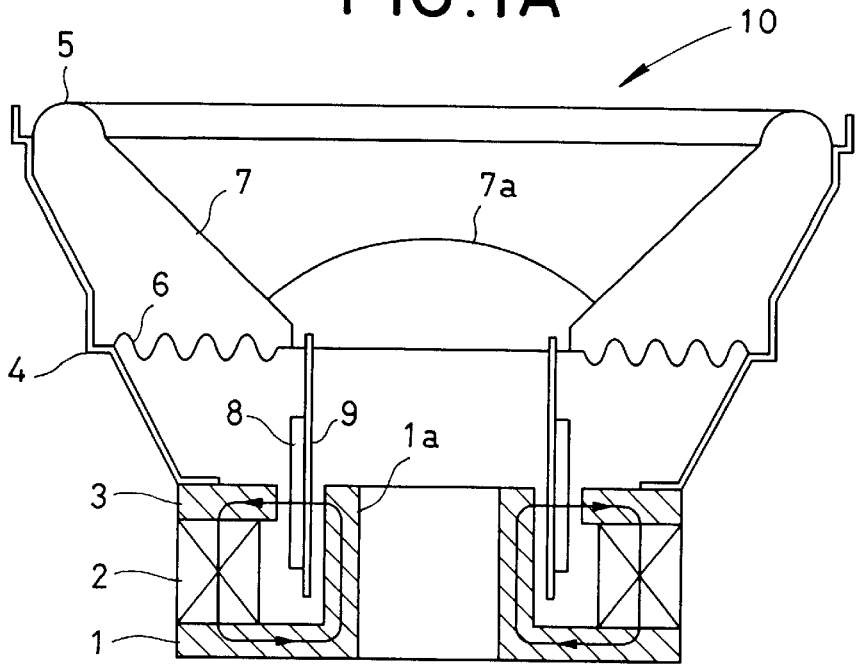
FIG. 1A is a cross-sectional view showing essential parts of a prior art speaker.
Figure 1B:
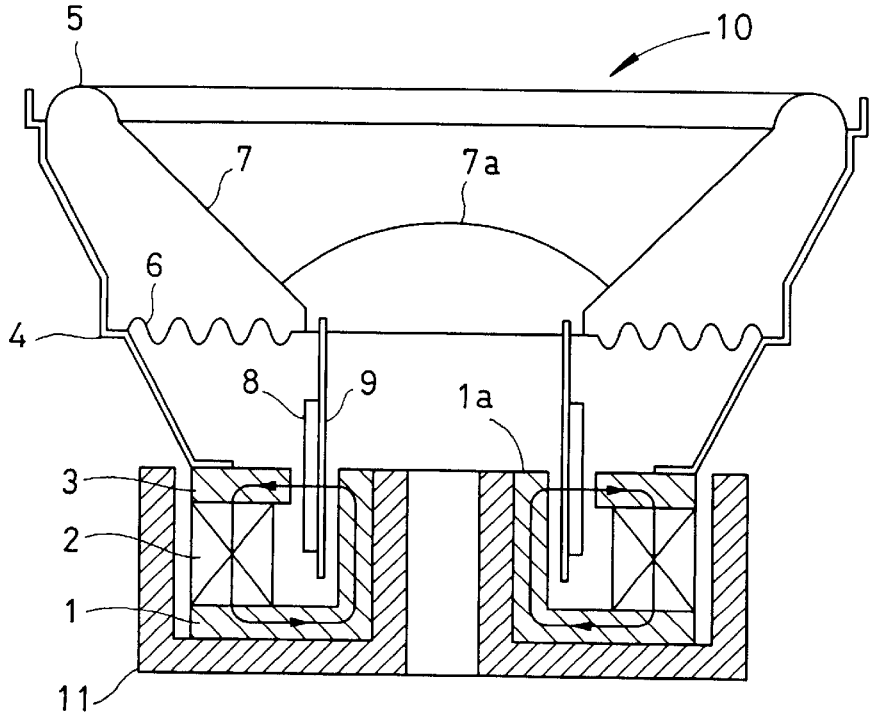
FIG. 1B is a cross-sectional view showing essential parts of the FIG. 1A prior art speaker having a cooling device mounted thereon.
Figure 2A:
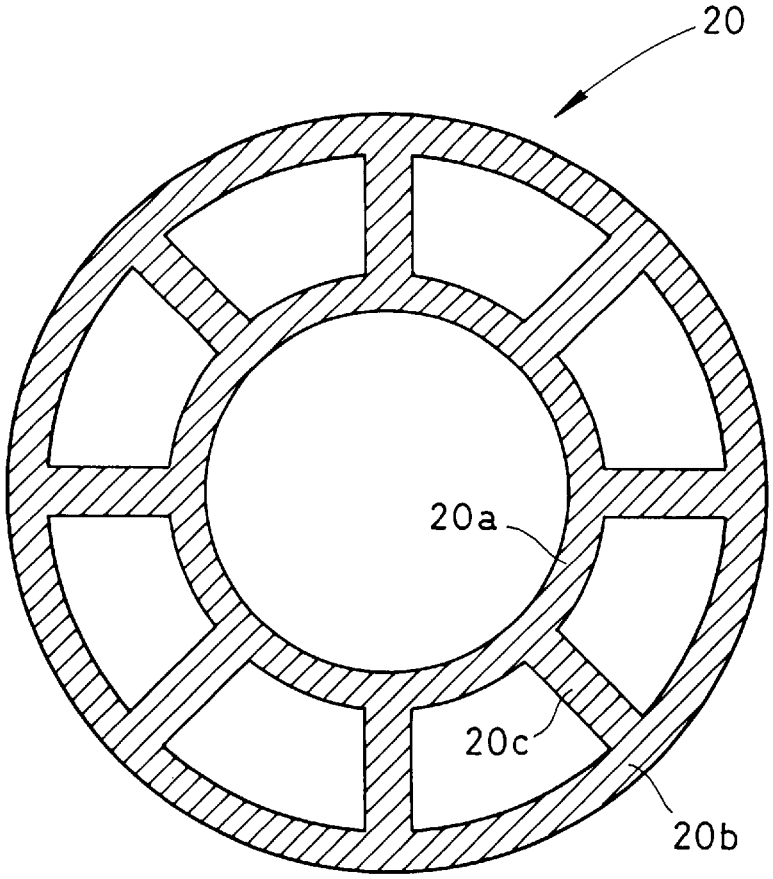
FIGS. 2A and 2B are outline views of a cooling device for a speaker system according to an embodiment of the invention.
Figure 2B:
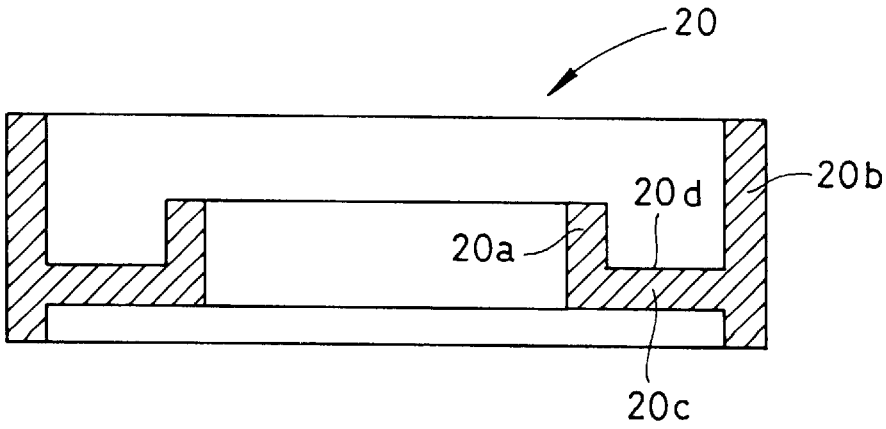

FIGS. 2A and 2B are outline views of a cooling device 20 for a speaker system, according to an embodiment of the invention. The cooling device 20 according to the embodiment of the invention is mounted on the inside of a bottom yoke 21 shown in FIGS. 3A, 3B, and FIGS. 4A, 4B. Therefore, not only the construction of the cooling device 20 but also that of the bottom yoke 21 will be described with reference to FIGS. 2A to 4B. It should be noted that FIGS. 2A and 2B are outline views of the cooling device 20, FIGS. 3A and 3B are outline views of the bottom yoke 21 of the speaker system, and FIGS. 4A and 4B are outline views of the bottom yoke 21 with the cooling device 20 attached thereto.

As shown in FIGS. 2A and 2B, the cooling device 20 is comprised of a first member 20*a* having a hollow cylindrical shape, a second member 20*b* having a hollow cylindrical shape, which is concentric with and has a larger diameter than the first member 20*a*, and a plurality of third members 20*c* each in the form of a plate, which are radially arranged between first member 20*a* and second member 20*b* for connecting first member 20*a* and second member 20*b* to each other. Further, the first member 20*a* and the third members 20*c* are welded to or integrally formed with each other, and the second member 20*b* and the third members 20*c* are also welded to or integrally formed with each other. All these members are formed of a material that is highly efficient in thermal conductivity, such as copper or the like. FIGS. 2A and 2B show an example of the cooling device 20 formed by the above-mentioned members integrally formed with each other.

Figure 3A:
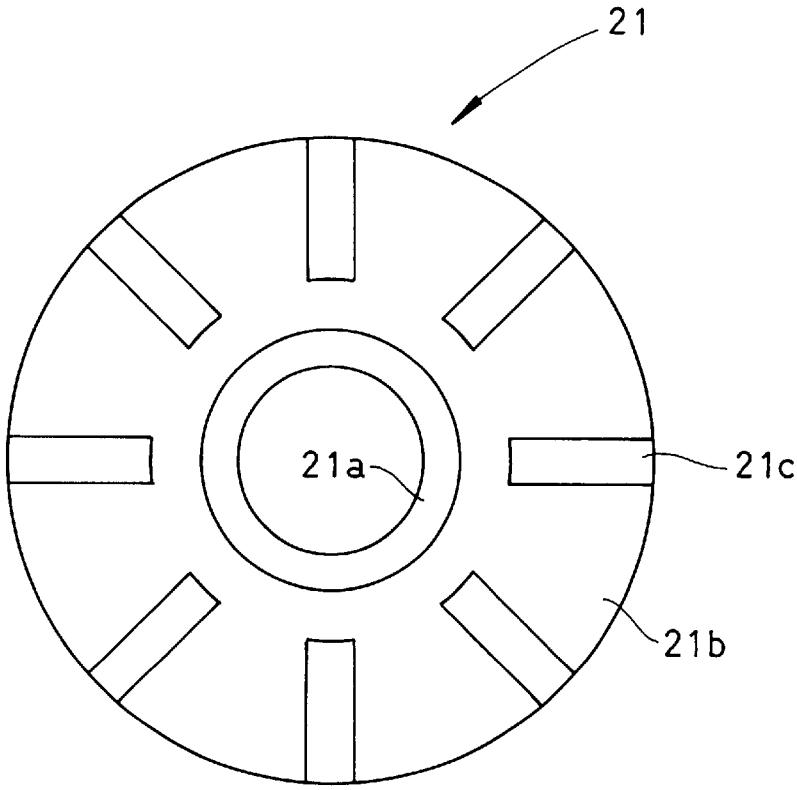
FIGS. 3A and 3B are outline views of a bottom yoke for having the cooling device mounted thereon according to the embodiment of the invention.
Figure 3B:
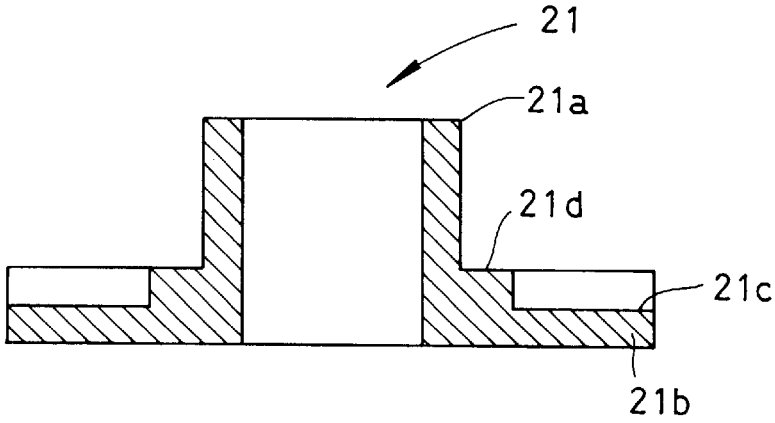
Figure 4A:
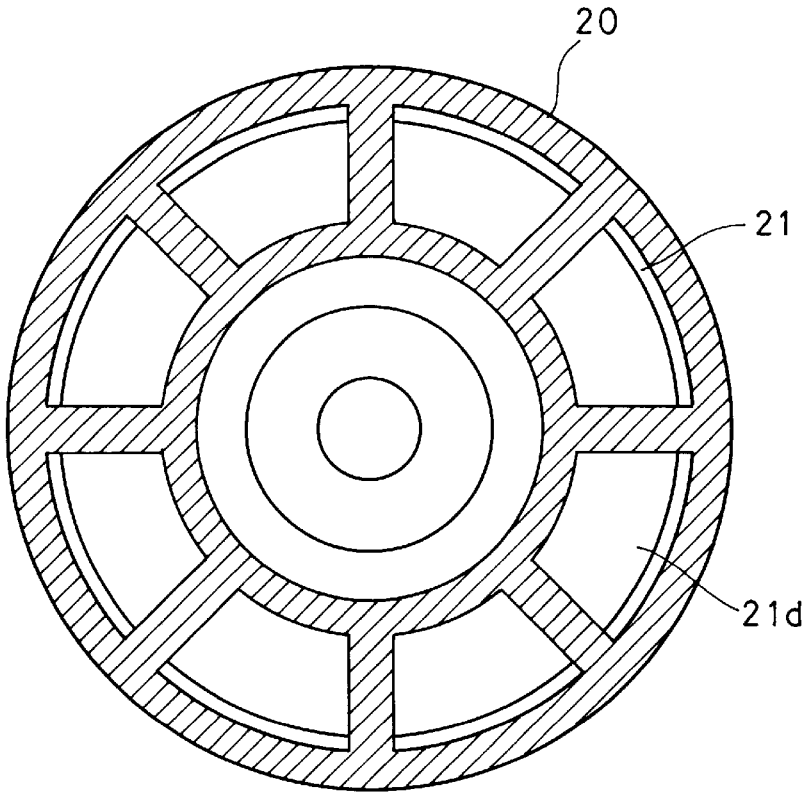
FIGS. 4A and 4B are outline views of the bottom yoke with the cooling device mounted thereon according to the embodiment of the invention.
Figure 4B:
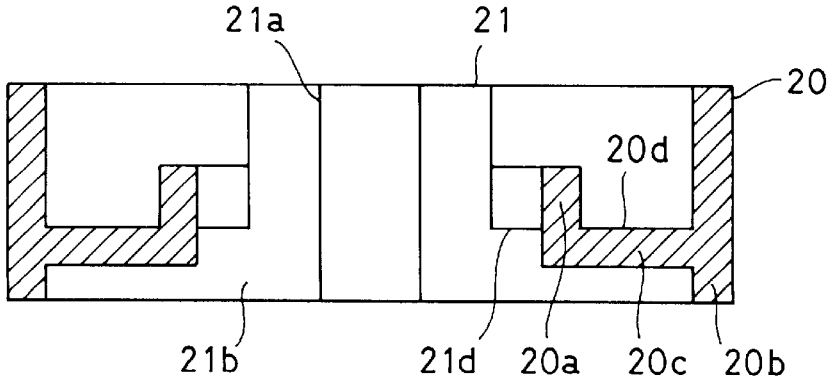

As shown in FIGS. 3A and 3B, the bottom yoke 21 is comprised of a pole portion 21*a* having a hollow cylindrical shape, and a bottom board portion 21*b* having a disk shape. On an upper surface 21*d* of the bottom board portion 21*b*, a plurality of insertion grooves 21*c* for mounting the third members 20*c* of the cooling device 20 are radially arranged at positions corresponding to the respective third members 20*c*.

The insertion grooves 21*c* of the bottom yoke 21 each have a depth approximately equal to the thickness of each of the third members 20*c*. Accordingly, when the cooling device 20 is mounted on the bottom yoke 21, as shown in FIGS. 4A and 4B, the upper surface 21*d* of the bottom board portion 21*b* is at substantially the same level as an upper surface 20*d* of each of the third members 20*c*, so that when the annular magnet 2 as a component of the magnetic circuit is placed on the bottom yoke 21, a bottom surface of the magnet 2 is brought into intimate contact with the upper surface 21*d* of the bottom board portion 21*b* and the upper surface 20*d* of each of the third members 20*c*.

Figure 5:
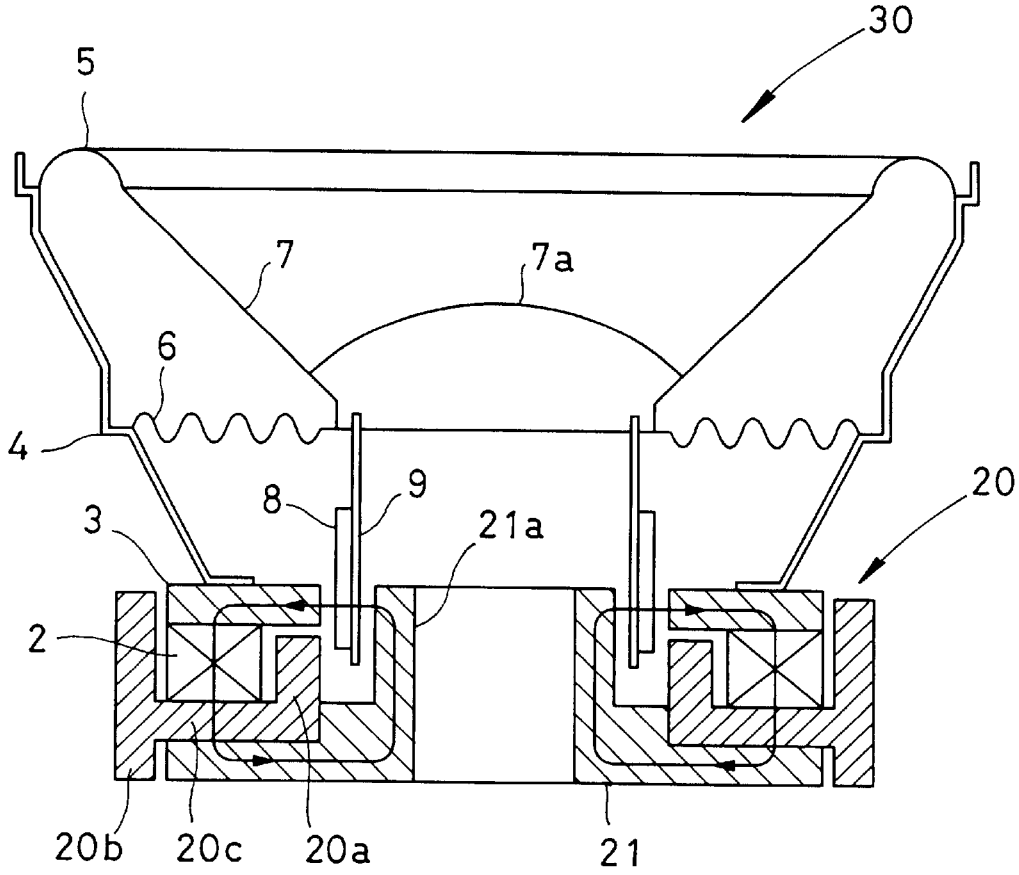
FIG. 5 is a cross-sectional view of the speaker system having the cooling device mounted thereon, according to the embodiment of the invention.

Next, the construction of a speaker system 30 incorporating the cooling device 20 according to the embodiment of the invention will be described with reference to FIG. 5. It should be noted that reference numbers of the components which correspond to the prior art components are numbered in the same manner. FIG. 5 shows the speaker system 30 including a magnetic circuit of an outer magnet type.

Referring to FIG. 5, the speaker system 30 includes a disk-shaped bottom yoke 21 with the pole portion 21*a*, which is formed of a magnetic metal member, and the cooling device 20 arranged at a predetermined position of the bottom yoke 21. The first member 20*a* as a component of the cooling device 20 is arranged adjacent to a voice coil 8 of the speaker system and at the same time inside a magnetic flux loop of a magnetic circuit of the speaker system. Hence, the first member 20*a* is formed to have an inner diameter larger than an outer diameter of the voice coil 8 such that a predetermined magnetic gap can be obtained. Further, the second member 20*b* forming the cooling device 20 is arranged outside the magnetic flux loop of the magnetic circuit, so that the second member 20*b* is formed to have an inner diameter larger than an outer diameter of an annular magnet 2. The annular magnet 2 and an annular top yoke 3 formed of a magnetic metal member are placed on the cooling device 20 to thereby form the magnetic circuit. Further, a diaphragm 7 with a dust cap 7*a* arranged at a center thereof is suspended on a frame 4 via an edge 5 and a damper 6, and joined to a coil bobbin 9. The coil bobbin 9 having a voice coil 8 wound therearound is arranged in a magnetic gap formed between the outer periphery of the pole portion 21*a* and the inner periphery of the top yoke 3.

As described above, when the cooling device 20 is mounted on the bottom yoke 21, the third members 20*c* are inserted into the insertion grooves 21*c*, and the upper surface 20*d* of the speaker system 20 is at substantially the same level as the upper surface 21*d* of the bottom yoke 21. Further, when the annular magnet 2 is placed at a predetermined position of the cooling device 20, most of the bottom surface of the magnet 2 is brought into intimate contact with the upper surface 21*d* of the bottom yoke 21. That is, the third members 20*c* of the cooling device 20 are interposed between the magnet 2 and the bottom yoke 21. By forming each of these third members 20*c* in the form of a plate and at the same time radially arranging the same, the magnetic flux density of the magnet 2 is prevented from being reduced. Therefore, the magnetic circuit constructed by fixedly attaching the top yoke 3 to the magnet 2 forms a magnetic path (indicated by arrows in the figure, for instance) extending from the magnet 2, through the bottom board portion 21*b* and pole portion 21*a* of the bottom yoke 2, to the top yoke 3 and a high-density uniform magnetic field is generated in the magnetic gap formed between the pole portion 21*a* and the top yoke 3.

When a drive current is supplied to the voice coil 8, the coil bobbin 9 arranged in the magnetic gap with predetermined spaces from the pole portion 21*a* and the top yoke 3 is actuated to perform a reciprocating motion by an electromagnetic force in the magnetic gap. When a large drive current is continuously supplied, the voice coil 8 generates Joule heat.

Since the speaker system 30 and the cooling device 20 therefor according to the invention are constructed such that the first member 20*a* is arranged adjacent to the voice coil 8, heat generated by the voice coil 8 is quickly transferred to the first member 20*a*. The heat transferred to the first member 20*a* is then transferred to the second member 20*b* via the third members 20*c*. The second member 20*b* is cooled off by the outside air temperature since the second member 20*b* is arranged outside the magnetic flux loop of the magnetic circuit.

The second member 20*b* of the cooling device 20 is always cooled off by the outside air temperature to thereby cool off the third members 20*c* joined to the second member 20*b*. The third members 20*c* then cool off the first member 20*a* joined thereto. The voice coil 8 has a periphery thereof covered by the first member 20*a* arranged adjacent to the same and cooled off as described above, which makes it possible to hold down an increase in the temperature of the voice coil 8.

Figure 6A:
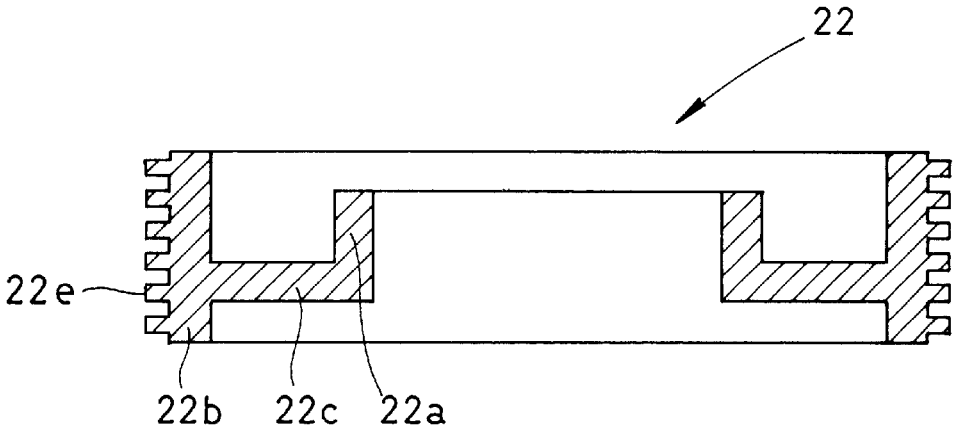
FIGS. 6A and 6B are outline views of a cooling device for a speaker system according to another embodiment of the invention.
Figure 6B:
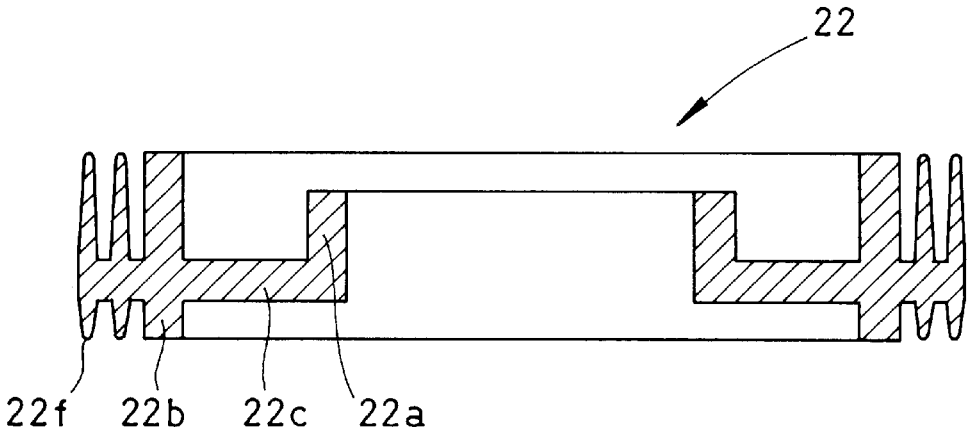

FIGS. 6A and 6B are outline views of a cooling device 22 for a speaker system according to another embodiment of the invention. A second member 22*b* of the cooling device 22 is arranged outside a magnetic flux loop of a magnetic circuit of the speaker system, so that if the cooling device 22 is used which is formed to have e.g. concave and convex portions 22*e* arranged on an outer peripheral surface of the second member 22*b*, as shown in FIG. 6A, or e.g. a fin 22*f* arranged on an outer periphery of the second member 22*b*, as shown in FIG. 6B, the speaker system 30 can be provided with increased heat dissipation.

Figure 7:
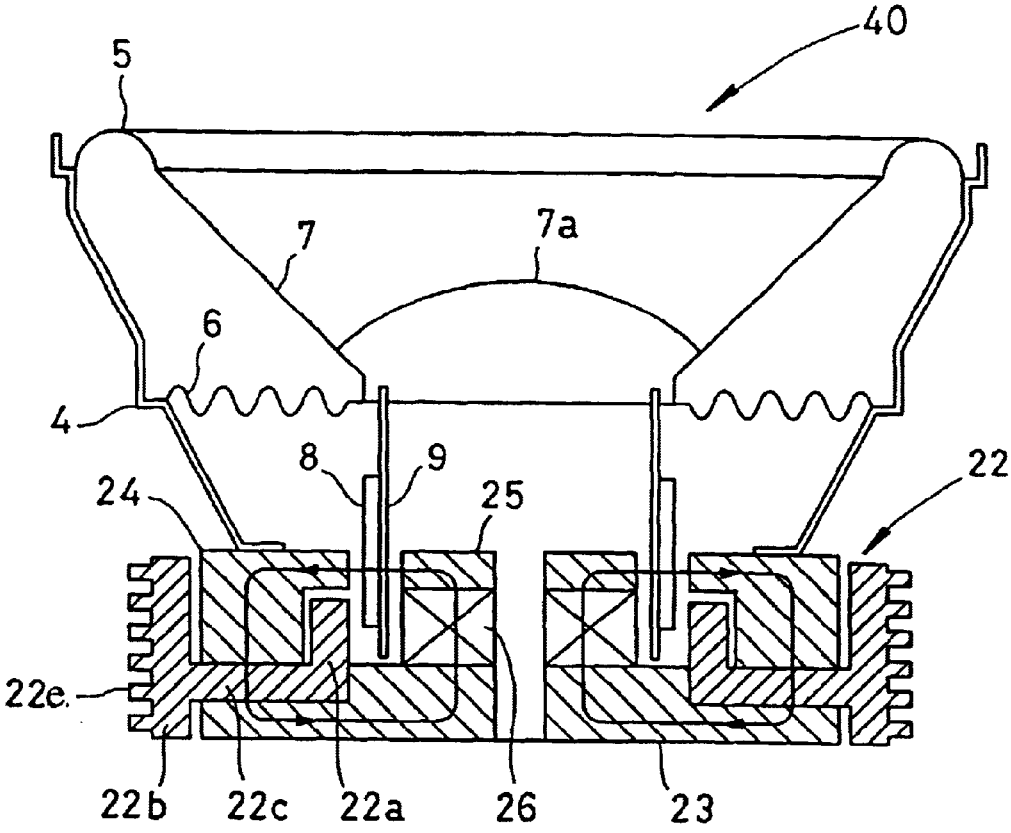
FIG. 7 is a cross-sectional view of an inner magnet type speaker system, to which the cooling device according to the embodiment of the invention is applied.

FIG. 7 shows a speaker system 40 according to still another embodiment of the invention, which includes a magnetic circuit of an inner magnet type.

In the speaker system 40 of the inner magnet type, the cooling device 22 is mounted on a disk-shaped bottom yoke 23. On the cooling device 22 is fixedly attached a top yoke 24, while a magnet 26 is placed on a portion of the bottom yoke 23 inside the coil bobbin 9, and further a center yoke 25 is fixedly attached to the magnet 26, whereby a magnetic circuit is formed.

In the case of the speaker system 40 of the inner magnet type, similar to the speaker system of the outer magnet type, the first member 22*a* of the cooling device 22 is arranged adjacent to the voice coil 8. Therefore, heat generated by the voice coil 8 is quickly transferred to the first member 22*a*, and then to the second member 20*b* via the third members 20*c*, thereby being cooled of f by the outside air temperature.

According to the speaker system and the cooling device of the invention, the first member is arranged adjacent to the voice coil 8, and inside the magnetic flux loop of the magnetic circuit, while the second member is arranged outside the magnetic flux loop. Further, the first member and the second member are connected to each other by the third members, and the first to third members are formed of a material that is highly efficient in thermal conductivity. Therefore, heat generated by the voice coil can be efficiently dissipated from the second member.

While there have been described preferred embodiments of the present invention, it is to be understood that various modifications and variations will occur to those skilled in the art without departing from the spirit and scope of the invention as hereinafter claimed.

What is claimed is:

1. A speaker system including a magnetic circuit having a magnetic gap, a voice coil arranged in said magnetic gap, and a diaphragm attached to said voice coil and suspended on a frame, said voice coil and said diaphragm being driven by supplying a drive current to said voice coil, the speaker system comprising:

a cooling device that includes:

a first member arranged adjacent to said voice coil and inside a magnetic flux loop generated by said magnetic circuit;

a second member arranged outside magnetic flux loop generated by said magnetic circuit; and a third member connecting said first member and said second member to each other, said third member disposed between said magnetic circuit and a yoke, wherein said first to third members are formed of a material that is efficient in thermal conductivity.

2. A speaker system according to claim 1, wherein said magnetic circuit is of an outer magnet type.

3. A speaker system according to claim 1, wherein said magnetic circuit is of an inner magnet type.

4. A speaker system according to claim 1, wherein the first member is sufficiently adjacent to the voice coil to promptly absorb a heat generated from the voice coil.

5. A speaker system according to claim 1, wherein the first member is an upright member.

6. A speaker system according to claim 5, wherein height of the first member is substantially the same as height of the voice coil.

7. A speaker system according to claim 1, wherein the first member surrounds the voice coil.

8. A speaker system according to claim 1, wherein the second member has concave and convex portions.

9. A speaker system according to claim 1, wherein the second member has fins.

10. A speaker system according to claim 1, said yoke comprising a bottom yoke and a top yoke, wherein said third member is disposed between said bottom yoke and said magnetic circuit.

11. A cooling device for a speaker system, comprising:

a first member arranged adjacent to said voice coil and inside a magnetic flux loop generated by said magnetic circuit;

a second member arranged outside magnetic flux loop generated by said magnetic circuit; and a third member connecting said first member and said second member to each other, said third member disposed between said magnetic circuit and a yoke, wherein said first to third members are formed of a material that is efficient in thermal conductivity wherein the cooling device is not a frame.

12. A cooling device according to claim 11, wherein heat generated by said voice coil is transferred to said second member via said first member and said third member to thereby allow said heat to be dissipated from said second member.

13. A cooling device according to claim 11, wherein said first to third members are integrally formed as a unitary member.

14. A cooling device for a speaker system according to claim 11, wherein the first member is sufficiently adjacent to the voice coil to promptly absorb a heat generated from the voice coil.

15. A cooling device for a speaker system according to claim 11, wherein the first member is an upright member.

16. A cooling device for a speaker system according to claim 15, wherein height of the first member is substantially the same as height of the voice coil.

17. A cooling device for a speaker system according to claim 11, wherein the first member surrounds the voice coil.

18. A cooling device for a speaker system according to claim 11, wherein the second member has concave and convex portions.

19. A cooling device for a speaker system according to claim 11, wherein the second member has fins.

20. A cooling device according to claim 11, said yoke comprising a bottom yoke and a top yoke, wherein said third member is disposed between said bottom yoke and said magnetic circuit.

21. A speaker apparatus comprising:

a frame;

a magnet unit supported by the frame for creating a magnetic circuit, the magnet unit having an upper yoke and a lower yoke;

a bobbin supported by the frame such that at least part of the bobbin is present in the magnetic circuit, the bobbin having a generally cylindrical shape, the bobbin having a height direction and a radial direction;

a voice coil arranged around the bobbin, the voice coil having a lower end and an upper end;

a diaphragm attached to the voice coil and supported by the frame such that the diaphragm and the voice coil are driven by a drive current supplied to the voice coil; and a cooling device including:

a first member extending in the height direction of the bobbin such that the first member is adjacent to the lower end of the voice coil;

a second member extending outwardly from the first member in the radial direction of the bobbin, and third member extending from the second member in the height direction of the bobbin such that the third member stands in parallel to the first member.

22. A speaker apparatus according to claim 21, wherein the lower end of the voice coil is below the top yoke.

23. A speaker apparatus according to claim 21, wherein the third member extends between the top yoke and the bottom yoke.

24. A speaker apparatus according to claim 21, wherein the second member has concave and convex portions.

25. A speaker apparatus according to claim 21, wherein the second member has fins.

* * * * *